US006963314B2

(12) United States Patent
Webb et al.

(10) Patent No.: US 6,963,314 B2
(45) Date of Patent: Nov. 8, 2005

(54) DYNAMICALLY VARIABLE BEAMWIDTH AND VARIABLE AZIMUTH SCANNING ANTENNA

(75) Inventors: David B. Webb, Dallas, TX (US); Jonathon Veihl, McKinney, TX (US); Michael D. Thomas, Richardson, TX (US); Mano D. Judd, Rockwall, TX (US)

(73) Assignee: Andrew Corporation, Orland Park, IL (US)

( * ) Notice: Subject to any disclaimer, the term of this patent is extended or adjusted under 35 U.S.C. 154(b) by 211 days.

(21) Appl. No.: 10/255,747

(22) Filed: Sep. 26, 2002

(65) Prior Publication Data

US 2004/0061653 A1 Apr. 1, 2004

(51) Int. Cl.[7] ..... H01Q 3/32
(52) U.S. Cl. ..... 343/844; 343/853; 342/374
(58) Field of Search ..... 343/815, 844, 343/853, 372–375; 342/372–375; 455/561

(56) References Cited

U.S. PATENT DOCUMENTS

| | | | | |
|---|---|---|---|---|
| 3,938,162 | A | 2/1976 | Schmidt | 343/840 |
| 3,999,182 | A | 12/1976 | Moeller et al. | 343/100 SA |
| 4,129,872 | A | 12/1978 | Toman | 343/768 |
| 4,178,581 | A | 12/1979 | Willey, Sr. | 343/108 |
| 4,314,378 | A | 2/1982 | Fowler et al. | 455/291 |
| 4,425,567 | A | 1/1984 | Tresselt | 343/373 |
| 4,626,858 | A | 12/1986 | Copeland | 342/374 |
| 4,916,454 | A | 4/1990 | Bull et al. | 342/373 |
| 5,214,436 | A | 5/1993 | Hannan | 343/705 |
| 5,281,974 | A | 1/1994 | Kuramoto et al. | 343/700 MS |
| 5,311,198 | A | 5/1994 | Sutton | 343/701 |
| 5,343,173 | A | 8/1994 | Balodis et al. | 333/126 |
| 5,504,466 | A | 4/1996 | Chan-Son-Lint et al. | 333/159 |
| 5,512,914 | A | 4/1996 | Hadzoglou et al. | 343/816 |
| 5,557,291 | A * | 9/1996 | Chu et al. | 343/725 |
| 5,563,610 | A | 10/1996 | Reudink | 342/375 |
| 5,629,713 | A | 5/1997 | Mailandt et al. | 343/808 |
| 5,771,017 | A | 6/1998 | Dean et al. | 342/374 |
| 5,798,675 | A | 8/1998 | Drach | 333/161 |
| 5,832,389 | A | 11/1998 | Dent | 455/562 |
| H1773 | H | 1/1999 | Cheston et al. | 342/375 |
| 5,861,844 | A | 1/1999 | Gilmore et al. | 342/374 |
| 5,889,494 | A | 3/1999 | Reudink et al. | 342/373 |
| 5,905,462 | A | 5/1999 | Hampel et al. | 342/372 |
| 5,936,591 | A | 8/1999 | Yamasa et al. | 343/853 |
| 5,940,030 | A | 8/1999 | Hampel et al. | 343/372 |
| 6,037,912 | A | 3/2000 | DeMarre | 343/815 |
| 6,070,090 | A | 5/2000 | Feuerstein | 455/561 |
| 6,088,003 | A | 7/2000 | Bassirat | 343/890 |
| 6,094,165 | A | 7/2000 | Smith | 342/373 |
| 6,094,166 | A | 7/2000 | Martek et al. | 342/374 |
| 6,097,267 | A | 8/2000 | Hampel | 233/128 |
| 6,172,654 | B1 | 1/2001 | Martek | 343/893 |
| 6,198,455 | B1 | 3/2001 | Luh | 343/781 |
| 6,198,458 | B1 | 3/2001 | Heinz et al. | |
| 6,246,674 | B1 | 6/2001 | Feuerstein et al. | 370/334 |
| 6,268,828 | B1 | 7/2001 | Martek | 342/373 |
| 6,317,100 | B1 | 11/2001 | Elson et al. | 343/853 |
| 6,323,823 | B1 | 11/2001 | Wong et al. | 343/844 |
| 6,346,924 | B1 | 2/2002 | Heinz et al. | |
| 6,538,619 | B2 | 3/2003 | Heinz et al. | |
| 6,603,436 | B2 * | 8/2003 | Heinz et al. | 343/757 |

* cited by examiner

*Primary Examiner*—Michael C. Wimer
(74) *Attorney, Agent, or Firm*—Wood, Herron & Evans, LLP

(57) ABSTRACT

A dynamically variable beamwidth and/or variable azimuth scanning antenna includes a plurality of active radiating columns and a plurality of continuously adjustable mechanical phase shifters. The columns define a beam having a beamwidth and an azimuth scan angle. Each phase shifter has an independent remotely controlled drive and is directly electrically connected to a respective radiating column. The phase shifters are independently operated to vary the beamwidth and/or azimuth scan angle of the beam defined by the plurality of active radiating columns.

68 Claims, 5 Drawing Sheets

DYNAMICALLY VARIABLE BEAMWIDTH AND VARIABLE AZIMUTH SCANNING ANTENNA

FIELD OF THE INVENTION

This invention relates generally to antennas, and more particularly to a mechanism for dynamically varying the beamwidth and azimuth scan angle of such antennas.

BACKGROUND OF THE INVENTION

An antenna may be constructed from a plurality of radiating elements arranged into a series of vertical radiating columns. In such an arrangement, the relative spacing of the columns determines the beamwidth of the antenna. The arrangement of the antenna will also typically dictate the direction of the center of the beam, i.e., the azimuth scan angle. In certain applications, it may be desirable to change the beamwidth and/or azimuth scan angle of an antenna.

One approach to changing the beamwidth of an antenna is to physically change the relative spacing of the columns, or to exchange or swap the antenna for another antenna having a different column spacing. Similarly, the azimuth scan angle may be, changed by adjusting the physical arrangement of the antenna. Typical of cellular and other communication applications, an antenna is placed atop a tower, a building or in other locations where physical access is limited. Changing the beamwidth or azimuth scan angle in such cases can be costly and difficult. Moreover, such physical handling of the antenna may require that service be interrupted during the handling process.

Other approaches for changing the beamwidth of an antenna involve variation of the phase of the electrical signal applied to the radiating columns. A relatively low cost and simple approach is to provide a series of ganged mechanical phase shifters which are varied in unison to affect the phase of the signal to the radiating columns, and hence, the beamwidth of the antenna. Such ganged mechanical phase shifters have the advantage of simplifying the beamwidth change, but are of limited utility. An approach which may have greater utility than the ganged mechanical phase shifters is a fully adaptive array or smart antenna. Smart antennas utilize electronic networks which present other drawbacks, however, including the fact that they are very complex and costly, and perhaps prohibitively so.

There is a need to provide a variable beamwidth and/or variable azimuth scan angle antenna that relies on the principle of phase shifters to adjust the beamwidth and/or azimuth scan angle with the advantages of both the ganged mechanical phase shifters and the smart antenna, but without their respective drawbacks.

BRIEF DESCRIPTION OF THE DRAWINGS

The accompanying drawings, which are incorporated in and constitute a part of this specification, illustrate embodiments of the invention and, together with the detailed description given below, serve to explain the principles of the invention.

DETAILED DESCRIPTION OF THE DRAWINGS

The present invention provides a dynamically variable beamwidth and/or variable azimuth scan angle antenna with most or all of the active radiating columns each being paired with its own independently controlled, continuously adjustable mechanical phase shifter by which to adjust the beamwidth and/or azimuth scan angle of the antenna. Therefore, the beamwidth and/or azimuth scan angle may be varied while the antenna is in operation. The beamwidth and/or azimuth scan angle may also be adjusted remote from the antenna.

Figure 1:
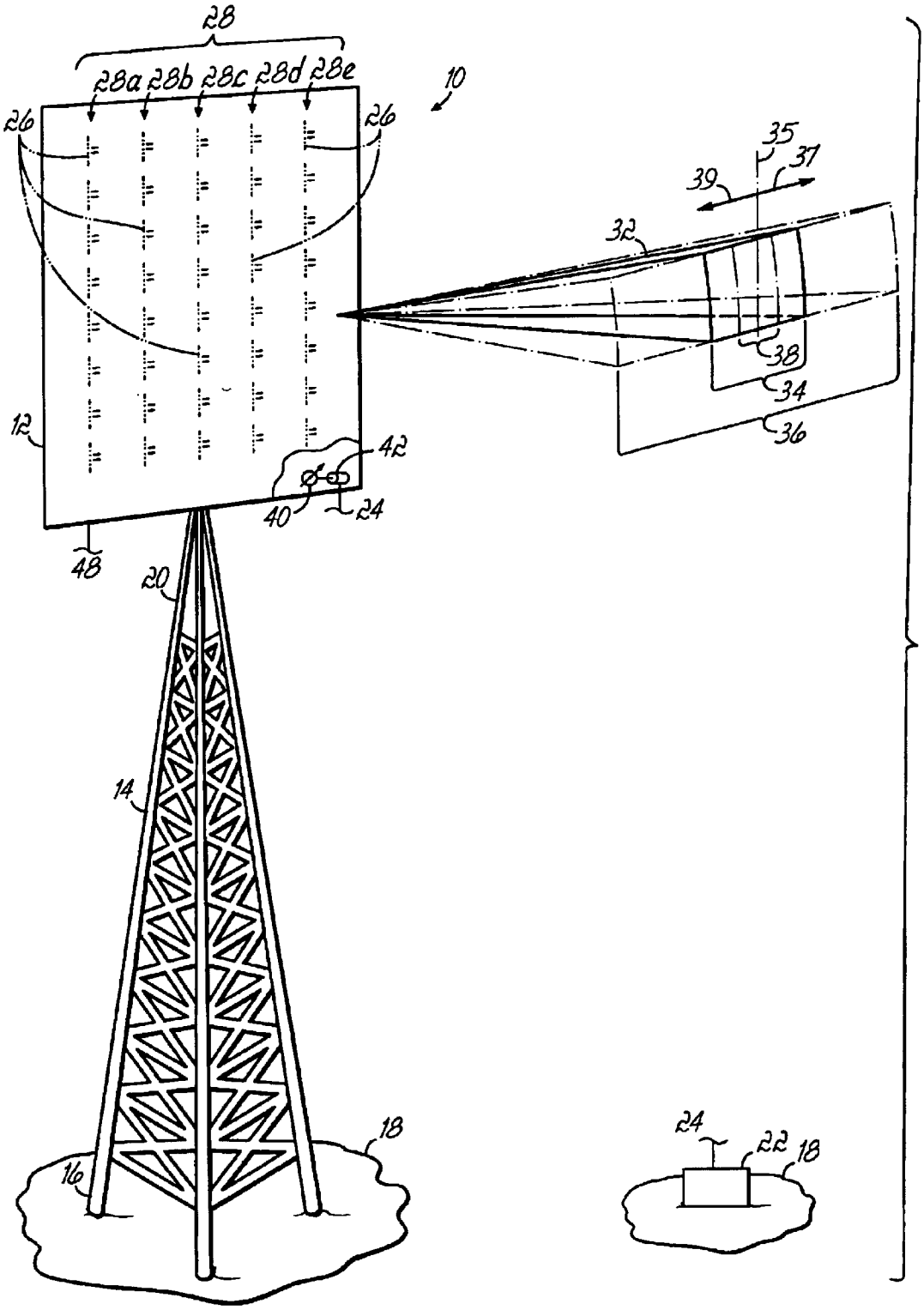
FIG. 1 is a diagram of an antenna system, not to scale, including an antenna, partially broken away, having a plurality of radiating columns mounted atop a tower for purposes of explaining the principles of the present invention.

Referring initially to FIG. 1, there is shown an exemplary antenna system 10 for purposes of explaining the principles of the present invention. Antenna system 10 includes at least one dynamically variable beamwidth and variable scan angle antenna 12, mounted to a support structure, such as a tower 14. Tower 14 has a base 16, a portion of which is typically buried in the ground 18, and a top 20 proximate to which antenna 14 is mounted. Other antennas (not shown) may share tower 14 with antenna 12 as will be readily appreciated by those skilled in the art.

Antenna system 10 may further include a control station 22 that electronically communicates with antenna 12, such as through a cable, an optical link, an optical fiber, or a radio signal, all as indicated at reference numeral 24, for varying the beamwidth and/or azimuth scan angle of the antenna 12 as will be described hereinafter. Control station 22 may be at or adjacent tower 14, or some distance away from tower 14. In the antenna system 10 depicted in FIG. 1, control station 22 is remote from tower 14. Control station 22 may be co-located with a central office (not shown).

Figure 2:
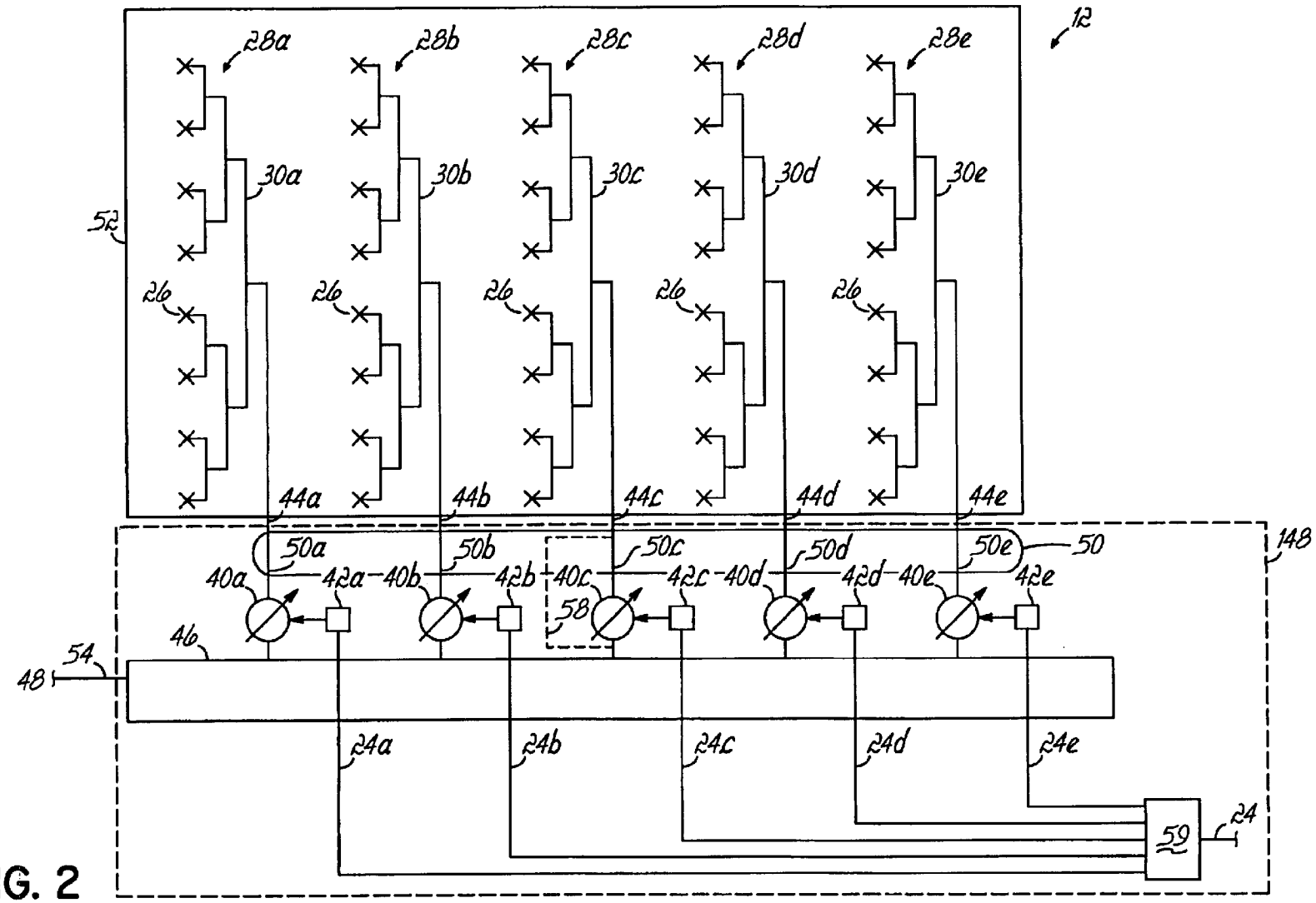
FIG. 2 is a schematic diagram of the dynamically variable beamwidth and/or variable azimuth scan angle antenna shown in FIG. 1.

Referring now to FIGS. 1 and 2, antenna 12 comprises a first plurality (M) of spaced-apart active radiating columns 28 each having a respective column signal node 50, and a second plurality (N) of continuously adjustable mechanical phase shifters 40 each having an independently remotely controlled drive 42 and being directly electrically connected to a respective radiating column 28 between the column signal node 50 thereof and the feed node 54. Referring primarily to FIG. 1, the active radiating columns 28*a–e* collectively define a beam 32 having a beamwidth 34 and/or a beam center 35 (indicated by a center line) correlated to an azimuth scan angle. The beamwidth 34 and/or the azimuth scan angle 37, 39 are correlated to phase shifts between the respective column nodes 50 and the feed node 54. In accordance with the principles of the present invention and as will be described hereinafter, the beamwidth 34 and/or azimuth scan angle 37, 39 may be varied such as in response to signal 24 from control station 22 so as to broaden or narrow the width of the beam 32, as exemplified by dashed lines at reference numerals 36 and 38, respectively, and/or move the center 35 of the beam 32 left or right, as indicated by arrows 37 and 39, respectively. To that end, the phase shifters 40 are independently operable in response to signal 24 to vary the phase shift, i.e., the phase of an electrical signal, between the respective column signal nodes 50 and the feed node 54, to thereby vary the beamwidth 34 and/or azimuth scan angle 33, 39 of the beam 32 defined by the plurality (M) of active radiating columns 28.

In the embodiment shown in FIG. 2, M=5 and N=5 (such that M=N), there being a series of spaced apart columns 28*a–e* and continuously adjustable mechanical phase shifters 40*a–e*. Each column 28 includes one or more radiating elements 26 (shown in phantom line in FIG. 1). The radiating elements 26 within each respective column 28 are electromagnetically coupled, such as through elevation feed networks comprising stripline or microstrip conductors, as shown at reference numerals 30*a–e* on circuit board 52 in FIG. 2. The radiating elements 26 may also be advantageously mounted on circuit board 52. Alternatively, the radiating elements within a column 28 may be coupled using air stripline and/or one or more power dividers having associated cabling (all of which are not shown), eliminating the need for a circuit board. Although the dynamically variable beamwidth antenna 12 shown in FIGS. 1 and 2 includes five columns (M=5), each column having eight elements 26, embodiments of the present invention may be configured using any desired number of columns and elements without departing from the spirit of the present invention.

With further reference to FIG. 2, electrically associated with each active radiating column 28*a–e* is a respective continuously adjustable mechanical phase shifter 40*a–e*. Each mechanical phase shifter 40*a–e* is coupled to a respective independent remotely controlled drive 42*a–e* (only one mechanical phase shifter 40 and one drive 42 being shown broken away in FIG. 1). Each respective mechanical phase shifter 40*a–e* is directly electrically connected, such as by coaxial cables 44*a–e* and/or striplines 30*a–e*, to the radiating elements 26 of a respective active radiating column 28*a–e*. Such direct electrical connections define column signal nodes 50*a–e*, respectively.

Each mechanical phase shifter 40*a–e* is also electrically coupled to an azimuth feed network 46, defining a feed node 54. Thus, as illustrated in the schematic diagram of FIG. 2, the mechanical phase shifters 40*a–e* are coupled intermediate column signal nodes 50*a–e*, respectively, and feed node 54. A radio frequency (RF) connection 48 couples signals to and from feed node 54 as will be readily appreciated. Mechanical phase shifters 40*a–e* may be adjusted independently to vary the phase of the columns 28*a–e*, respectively.

Azimuth feed network 46 may be implemented on a circuit board in the form of traces, a series of discrete power dividers and associated cabling, or other structures (all not shown), to provide a serial or corporate feed, as will be appreciated by those skilled in the art. Azimuth feed network 46 divides power input at node 54 among the active radiating columns 28*a–e* to radiate a signal from antenna 12. Conversely, in receiving a signal, azimuth feed network 46 combines power incident on elements 26 in the radiating columns 28*a–e* to be received at feed node 54.

Mechanical phase shifters 40*a–e* and their drives 42*a–e* are advantageously mounted directly adjacent their respective radiating columns 28*a–e* of antenna 12. Such mounting furthers the use of azimuth feed network 46 in antenna 12, allowing a single RF connection 48 to antenna 12 thereby reducing the number of cables that must traverse tower 14.

Each drive 42*a–e* is independently remotely controlled using signal(s) coupled through a cable, an optical link, an optical fiber, or a radio signal as indicated at reference numeral 24. As shown in FIG. 2, each drive 42*a–e* may have its own respective signal 24*a–e*. Using conventional means of addressing, signals 24*a–e* may be multiplexed as provided by interface 59.

Each mechanical phase shifter 40 may be used to vary the phase or delay of a signal between feed node 54 and the respective column node 50. Further, phase shifters 40*a–e* may also be used to vary or stagger the phase between the respective nodes 50*a–e*, thereby varying the phase between the radiating columns 28*a–e*. The differences in phase between the radiating columns 28*a–e*, associated with transmission and reception of signals from antenna 12 determines the beamwidth and/or azimuth scan angle of antenna 12.

Generally, in varying the beamwidth 34 of such an antenna, a phase delay will be added to or subtracted from the radiating columns 28*a–e* such that a greater amount of change in delay is applied to the outer most columns. A mathematical equation may be derived that relates the phase differences between the radiating columns 28*a–e* in varying the beamwidth 34. One such equation may be a second order linear equation, or a quadratic equation. Similarly, in varying the azimuth scan angle 37, 39, a phase delay may be added to one end of the columns 28*a–e* in the plurality of columns while a phase delay may be subtracted from those columns at the other end. One mathematical equation that relates the phase differences between the radiating columns 28*a–e* in varying the azimuth scan angle 37,39 is a first order linear equation. Those skilled in the art will appreciate that other equations, such as higher order polynomial equations, relating the differences in phase between the radiating columns may also be used and/or derived. Moreover, those skilled in the art will appreciate that a combination of equations each relating phase differences between the radiating columns, such as a linear and a quadratic equation, may be used in varying both beamwidth 34 and azimuth scan angle 37, 39.

The beamwidth 34 of such an antenna may be varied from approximately 30° to approximately 180°, depending on the arrangement of the columns, for example, while the azimuth scan angle 37, 39 may be varied by approximately +/−50° (denoting left and right 37, 39 as shown in FIG. 1). The ability to vary the azimuth scan angle 37, 39 depends on the beamwidth 34 selected. For example, if a beamwidth 34 of 40° is selected, the azimuth scan angle 37, 39 may be varied +/−50°. However, if a beamwidth 34 of 90° is selected, the azimuth scan angle 37, 39 may be limited such as to +/−40°. Those skilled in the art will appreciate that other beamwidths 34 may be selected that correspondingly affect the range of variability of the azimuth scan angle 37, 39.

Thus, according to the principles of the present invention, and as illustrated in FIGS. 1 and 2, the phase shifters 40*a–e* are independently and remotely operable to vary the beamwidth 34 and/or azimuth scan angle 37, 39 of antenna 12. Moreover, such an adjustment in beamwidth 34 and/or azimuth scan angle 37, 39 is possible while antenna 12 is in operation, i.e., dynamically.

Since the difference in phase between columns determines the beamwidth and/or azimuth scan angle of such an antenna, one or more of the columns may be fixed in phase with respect to the signal transmitted by or received using the antenna, thereby varying the phase of only those remaining columns. For example, as shown in FIG. 2, phase shifter 50*c*, and its associated drive 42*c* and control signal 24*c*, could be eliminated as indicated by connection 58 (shown in dashed line), shorting nodes 50*c* and 54, such that N=4 (or M=N+1). Phase shifters 28*a–b*, 28*d–e*, may then vary the signals at nodes 50*a–b*, 50*d–e* with respect to the signal at shorted nodes 50*c* and 54 to vary the beamwidth and/or azimuth scan angle of antenna 12. Elimination of a phase shifter 50*c* and its associated drive 42*c* reduces the cost of the antenna 12. Those skilled in the art will recognize that other embodiments of the present invention may be constructed using differing numbers of columns (M) and phase shifters (N).

The mechanical phase shifters 40 may, for example, be linear or rotary. Either type of phase shifter may be coupled to a drive 42, such as a motor or other suitable means, to move a piece of dielectric material relative to a conductor within the phase shifter, to thereby vary the insertion phase of a signal between input and output ports of the device.

Figure 3:
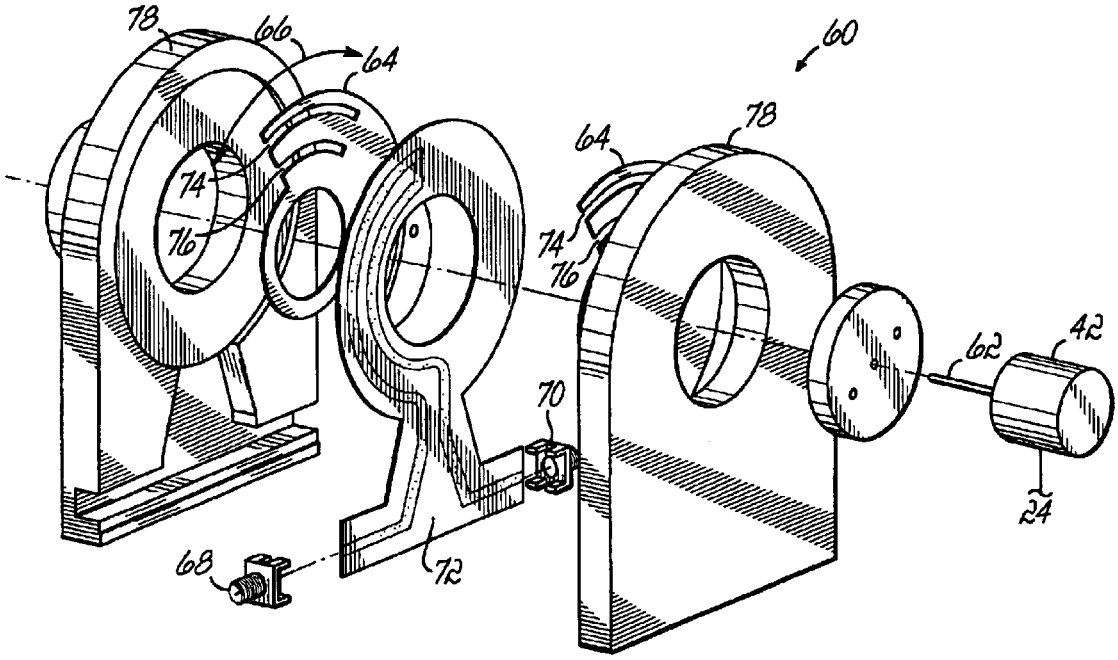
FIG. 3 is an exploded view of an exemplary rotary mechanical phase shifter including a drive.

Referring to FIG. 3, an exploded view of an exemplary rotary mechanical phase shifter 60 including a drive, or motor, 42 is illustrated. Motor 42 is responsive to a control signal 24 and includes a shaft 62. Shaft 62 may be coupled directly to the mechanical phase shifter 60, as shown in FIG. 3, or through a gearbox, pulleys, etc. (not shown). Shaft 62 is coupled to a high dielectric constant material 64 that is rotated, as indicated by arrow 66, in a housing 78.

Rotary mechanical phase shifter 60 varies the phase shift between input and output ports 68, 70 by rotating 66 high dielectric constant material 64 on both sides of stripline center conductor 72. The high dielectric constant material 64 has a slower propagation constant than air, and thus increases electrical delay of a signal carried by conductor 72. Slots 74, 76 provide a gradient in the dielectric constant. Alternatively, a plurality of holes or other apertures in the high dielectric constant material 64 may be used to provide a gradient in the dielectric constant. The amount of delay, or phase shift, is determined by the relative length of conductor 72 covered above and/or below by the high dielectric constant material 64. Thus, the rotation 66 of high dielectric constant material 64 relative to conductor 72 varies the phase of a signal between ports 68 and 70 of the phase shifter 60. Housing 78 may be constructed using aluminum or some other suitably rigid material.

Another example of a rotary mechanical phase shifter may be found in an article entitled, "A Continuously Variable Dielectric Phase Shifter" by William T. Joines, *IEEE Transactions on Microwave Theory and Techniques*, August 1971, the disclosure of which is incorporated herein by reference in its entirety.

Figure 4:
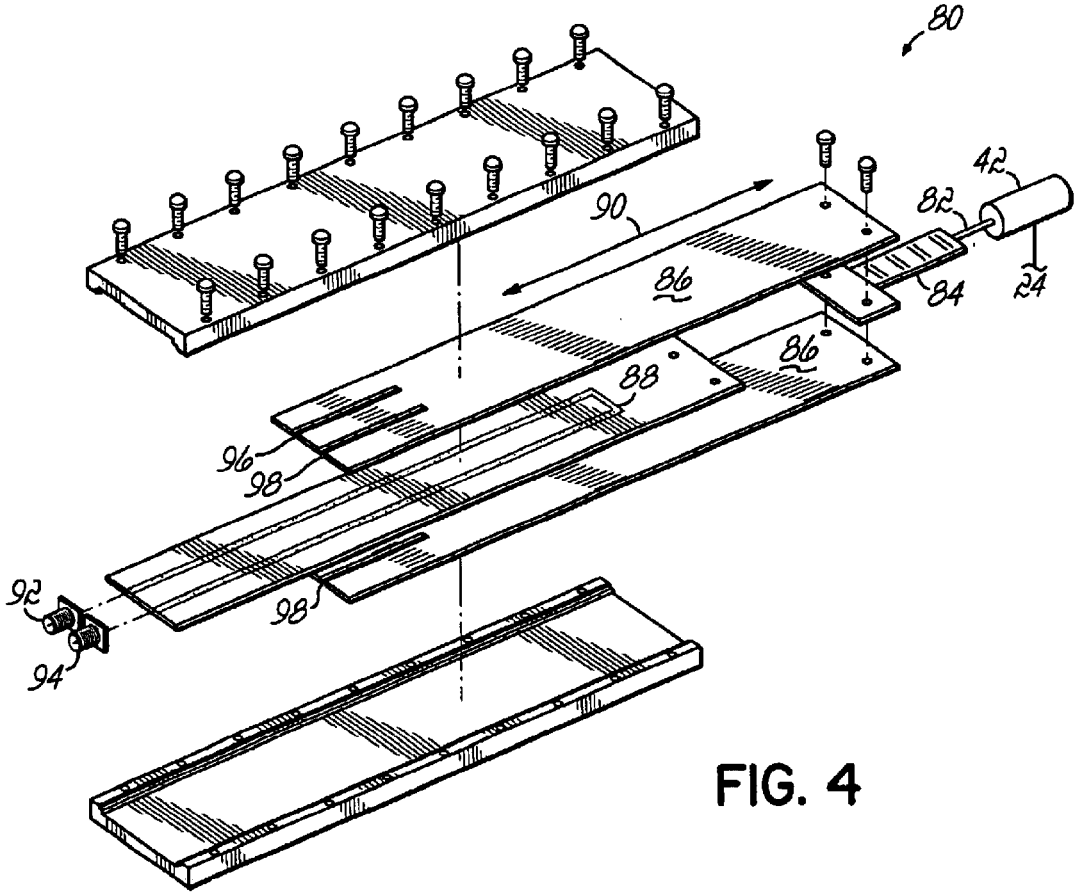
FIG. 4 is an exploded view of an exemplary linear mechanical phase shifter including a drive.

Referring to FIG. 4, an exploded view of an exemplary linear mechanical phase shifter 80 is illustrated. As illustrated, linear mechanical phase shifter 80 is coupled to a drive, such as a motor 42, having a shaft 82. Shaft 82 couples through a mechanism, such as a worm gear 84, to slab(s) 86 of a high dielectric constant material within the phase shifter 80. In response to signal 24, drive 42, through shaft 82 and worm gear 84, moves high dielectric constant material 86 linearly relative to a conductor 88, as indicated at by arrow 90.

The high dielectric constant material 86 has a slower propagation constant than air, and thus increases the electrical delay of a signal carried by conductor 88. Slots 96, 98 provide a gradient in the dielectric constant. The amount of delay, or phase shift, is controlled by the relative length of the conductor 88 that is covered, above and/or below, by the high dielectric constant material 86. Thus, the linear position of the high dielectric constant material 86 relative to conductor 88 determines the phase of a signal between ports 92 and 94 of the phase shifter 80.

Another example of linear phase shifter may be found in U.S. Pat. No. 3,440,573, the disclosure of which is incorporated herein by reference in its entirety. Yet another example of a linear phase shifter may be found in U.S. Pat. No. 6,075,424, the disclosure of which is also incorporated herein by reference in its entirety.

Figure 5:
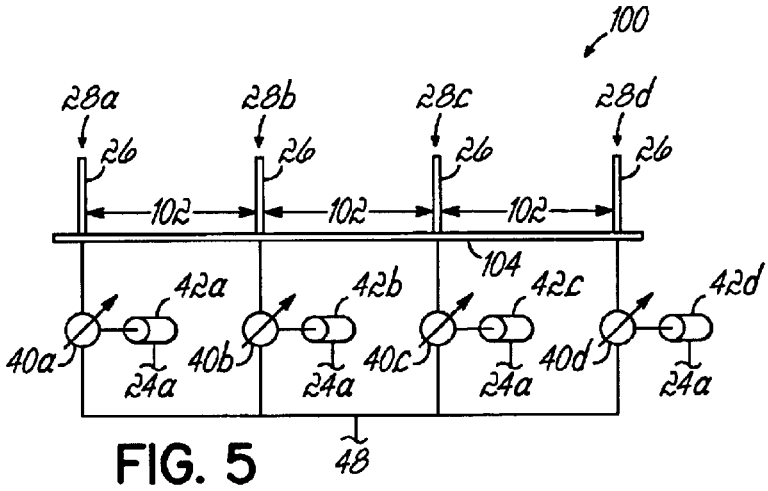
FIG. 5 is a top view of an embodiment of an active radiating column arrangement for use with the present invention.
Figure 6:
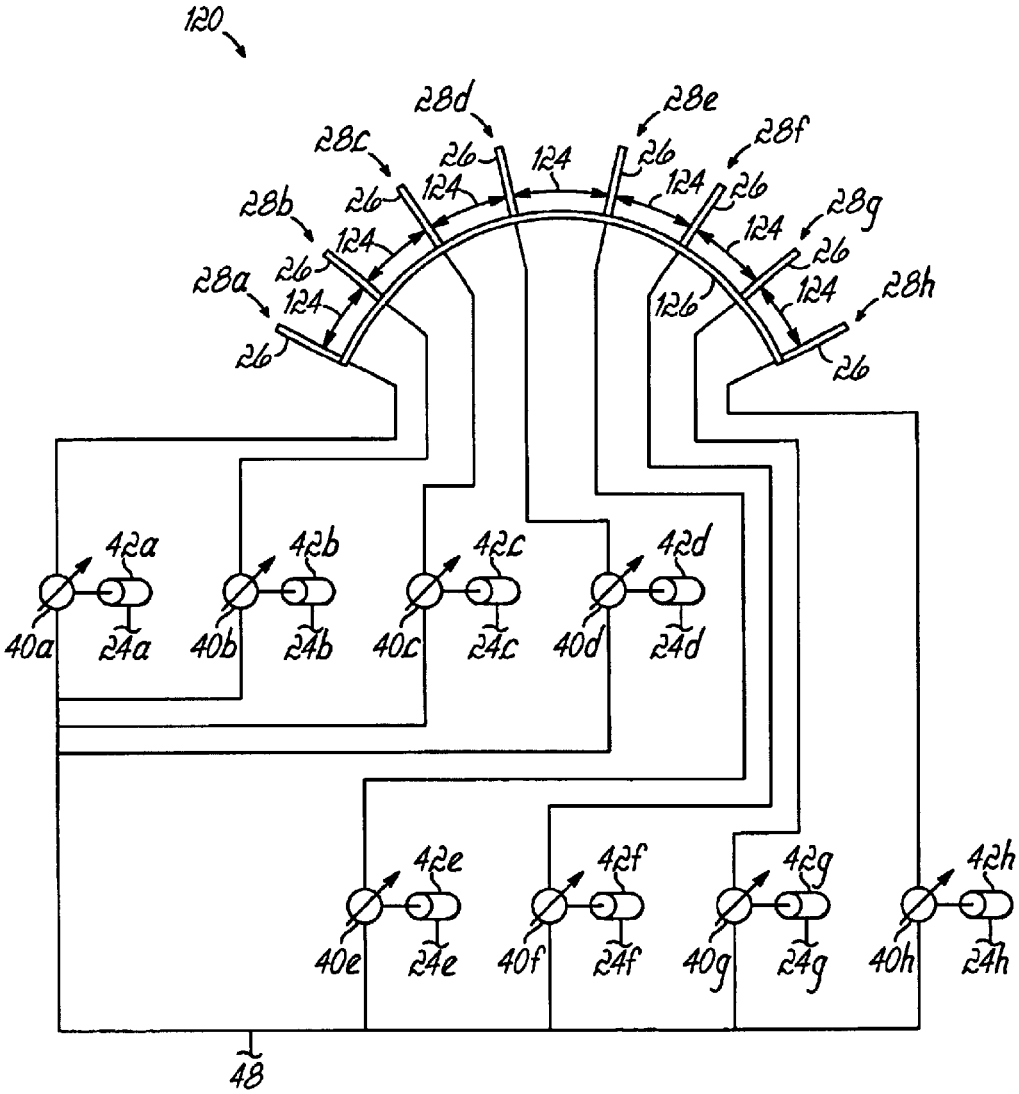
FIG. 6 is a top view of another embodiment of a column arrangement for use with the present invention.
Figure 7:
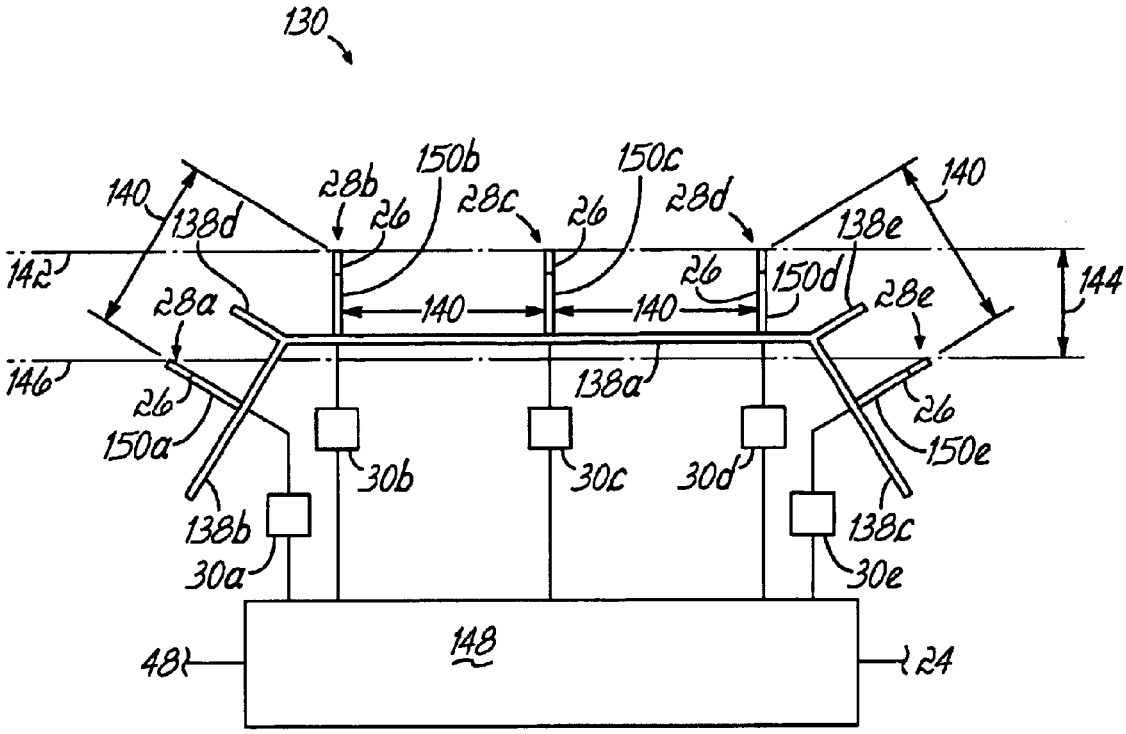
FIG. 7 is a top view of a further embodiment having an irregular or linearly segmented column arrangement for use with the present invention.

In addition to the phase relationships between the columns, the number of columns, the spacing between the columns, and the relative position of the columns in an antenna may determine the ability to vary beamwidth and/or azimuth scan angle as desired. FIGS. 5–7 illustrate top views of three antennas 100, 120, and 130 each having a particular column arrangement. Those skilled in the art will appreciate that the present invention is not limited to any one of these arrangements, they are merely shown by way of example.

Referring to FIG. 5, an antenna 100 having a flat, planar, or linear arrangement of columns is illustrated. Antenna 100 includes four (M=4) substantially equally spaced (by a distance 102) active radiating columns 28*a–d*, each containing a plurality of radiating elements 26 advantageously mounted to a circuit board, or reflector, 104. The radiating elements 26 within each respective column 28*a–d* are coupled using stripline, microstrip, or air stripline (none of which are shown), as described hereinabove. The active radiating columns 28*a–d* are directly electrically connected to respective ones of a plurality of continuously adjustable mechanical phase shifters 40*a–d*, each coupled to a respective independently remotely controlled drive 42*a–d* (although at least one of the phase shifters 40 may be eliminated as discussed earlier in connection with FIG. 2). In operation, control signals 24*a–d* actuate drives 42*a–d* adjusting the mechanical phase shifters 40*a–d*, so as to dynamically vary the beamwidth and/or azimuth scan angle of antenna 100 as described hereinbefore.

Referring to FIG. 6, an antenna 120 having an arcuate, curvilinear or cylindrical arrangement of active radiating columns 28*a–h* is illustrated. Antenna 120 comprises a plurality of radiating elements 26 arranged into the eight (M=8) substantially equally spaced (by a distance 124) active radiating columns 28*a–h* by mounting the elements 26 to a similarly arcuate, curvilinear or cylindrical curved reflector 126 having a stripline or microstrip traces (not shown) for coupling the respective radiating elements 26 with each column 28*a–h*. Antenna 120 further comprises a plurality of continuously adjustable mechanical phase shifters 40*a–h* (N=8, although N<8 could be used), each coupled to a respective independently remotely controlled drive 42*a–h*. In operation, control signals 24*a–h* actuate drives 42*a–h* adjusting the mechanical phase shifters 40*a–h*, so as to dynamically vary the beamwidth and/or azimuth scan angle of antenna 120 as described hereinbefore.

Referring also to FIG. 1, the arcuate, curvilinear or cylindrical arrangement 120 of active radiating columns 28*a–h* shown in FIG. 6 may allow for wider beam 32 broadening 36 than that of a linear arrangement 100, as shown in FIG. 5. The spacing 124 of columns 28*a–h*, such as advantageously on substantially quarter (0.25) wavelength intervals of the center frequency of the antenna 120, reduces antenna 120 side lobes at the expense of increased mutual coupling between adjacent elements 26 in adjacent columns 28*a–h*.

Referring to FIG. 7, an antenna 130 having an irregular or linearly segmented arrangement of five (M=5) active radiating columns 28*a–e*, each containing a plurality of radiating elements 26, is illustrated. The radiating elements 26 in each radiating column 28*a–e* comprise conductive elements on one or more circuit boards 150*a–e* in each column 28*a–e*. The circuit boards 150*a–e* are advantageously mounted to one or more sheet metal reflectors 138*a–c*, reflectors 138*ac* including one or more holes or apertures (not shown) for electrically coupling to elements 26 in radiating columns 28*a–e*, sheet metal reflectors 138*d* and 138*e* functioning to isolate column 28*a* from column 28*b* and column 28*d* from column 28*e*, respectively. The radiating elements 26 within each active radiating column 28*a–e* are electromagnetically coupled using elevation feed networks 30*a–e* as described in conjunction with FIG. 2, the elevation feed networks being located behind reflectors 138*a–e*. For example, if eight active radiating elements 26 were used per active radiating column 28*a–e*, then eight cables from each elevation feed network 30*a–e* may be used to electromagnetically coupling the radiating elements 26 within each column 28*a–e*. Alternatively, the radiating elements 26 within each respective column 28 may be electromagnetically coupled using a combination of stripline or microstrip conductors located on circuit boards 150*a–e* and one or more power dividers having associated cabling, located behind reflectors 138*a–e*. Antenna 130 includes a plurality of mechanical phase shifters 40*a–e* and their associated drives 42*a–e* as previously described in conjunction with FIG. 2 and indicted by reference numeral 148 in both FIGS. 2 and 7.

Columns 28*a–e* are substantially equally spaced (by a distance 140), columns 28*b–d* being arranged in substantially a first plane 142. Columns 28*a* and 28*e* are substantially equally spaced 140 from columns 28*b* and 28*d*, respectively, and set back (by a distance 144) from first plane 142 in a second plane 146 substantially parallel to plane 142. The columns 28*a–e* are advantageously spaced 140 at approximately 0.466 times the wavelength of the center frequency of the antenna 130. Such an irregular or linearly segmented arrangement 130 allows beam 32 broadening 36 (as shown in FIG. 1), typically associated with an arcuate, curvilinear or cylindrical arrangement 120 (as shown in FIG. 6) while reducing the mutual coupling between adjacent elements in adjacent columns.

By virtue of the foregoing, there is thus provided a dynamically variable beamwidth and/or variable azimuth scanning angle antenna that relies on the principle of phase shifters to adjust the beamwidth and/or azimuth scan angle with the advantages of both the ganged mechanical phase shifters and the smart antenna, but without their respective drawbacks.

While the present invention has been illustrated by the description of embodiments thereof, and while the embodiments have been described in considerable detail, it is not the intention of applicants to restrict or in any way limit the scope of the appended claims to such detail. Additional advantages and modifications will readily appear to those skilled in the art. It will be understood that an antenna consistent with the present invention may be utilized as a transmit or receive antenna independently or simultaneously, thereby broadening or narrowing the transmit or receive beamwidth and/or steering the beam center accordingly as desired. Further, the present invention is not limited in the type of radiating elements used. Any type of radiating elements may be used, as appropriate. The invention is also not limited in the number of rows of radiating elements, nor does it necessitate rows, per se. The invention may also be used with or without antenna downtilt, either mechanical or electrical. Moreover, the azimuth distribution network described herein may incorporate the ability to vary the amplitude of a signal at the respective column signal nodes furthering the ability to vary the beamwidth and/or azimuth scan angle. Still further, although the relationship of columns (M) to phase shifters (N) is advantageously M=N or M=N+1, in some circumstances, it may be possible to fix the phase of more than one column, such that M>N. Those skilled in the art will also appreciate that an antenna in accordance with the present invention may be mounted in any location and is not limited to those mounting locations described herein. The invention in its broader aspects is therefore not limited to the specific details, representative apparatus and method, and illustrative examples shown and described. Accordingly, departures may be made from such details without departing from the spirit and scope of applicants' general inventive concept.

What is claimed is:

1. A dynamically variable beamwidth and variable azimuth scanning antenna comprising:

a first plurality (M) of spaced-apart active radiating columns each having a plurality of radiating elements and a respective column signal node, the columns collectively defining a beam having a beamwidth and an azimuth scan angle correlated to phase shifts between the respective column signal nodes and a feed node; and a second plurality (N) of continuously adjustable mechanical phase shifters each having an independent remotely controlled drive and being directly electrically connected to a respective radiating column between the column signal node thereof and the feed node, the phase shifters each being independently operable to vary the phase shift equally for all of the radiating elements of the respective column to which the phase shifter is connected to thereby vary at least one of the beamwidth and the azimuth scan angle of the beam defined by the plurality of active radiating columns.

2. The antenna of claim 1, wherein M=N.

3. The antenna of claim 1, wherein M=N+1.

4. The antenna of claim 1, wherein the active radiating columns are spaced apart in a linear pattern.

5. The antenna of claim 1, wherein the active radiating columns are spaced apart in a curvilinear pattern.

6. The antenna of claim 1, wherein M=8.

7. The antenna of claim 1, wherein the active radiating columns are spaced apart at substantially quarter wavelength intervals.

8. The antenna of claim 1, wherein the active radiating columns are spaced apart in a linearly segmented pattern.

9. The antenna of claim 1, the columns being defined between a pair of outside columns and remaining columns therebetween, at least the remaining columns being arranged substantially in a plane.

10. The antenna of claim 9, wherein the pair of outside columns are substantially arranged in a second plane.

11. The antenna of claim 9, wherein the pair of outside columns are spaced apart from the first plane.

12. The antenna of claim 11, wherein the pair of outside columns are substantially arranged in a second plane.

13. The antenna of claim 9, wherein M=5.

14. The antenna of claim 9, wherein the active radiating columns are space apart at approximately 0.466 wavelength intervals.

15. The antenna of claim 1, wherein the mechanical phase shifters are located proximate the respective active radiating column.

16. The antenna of claim 1, wherein the mechanical phase shifters are linear phase shifters.

17. The antenna of claim 1, wherein the mechanical phase shifters are rotary phase shifters.

18. The antenna of claim 1, further comprising a control station, the control station electronically communicating with the antenna using signals, each signal associated with a respective independently controlled drive and used to actuate the drive, thereby adjusting the phase shifter, and vary the beamwidth of the antenna.

19. The antenna of claim 18, wherein the signals are multiplexed.

20. The antenna of claim 18, wherein the signals are communicated using at least one of a cable, an optical link, an optical fiber, and a radio signal.

21. An antenna system, comprising:

a tower having a top and a base; and a dynamically variable beamwidth and variable azimuth scanning antenna mounted on the tower, the antenna comprising:

a first plurality (M) of spaced-apart active radiating columns each having a plurality of radiating elements and a respective column signal node, the columns collectively defining a beam having a beamwidth and an azimuth scan angle correlated to phase shifts between the respective column signal nodes and a feed node; and a second plurality (N) of continuously adjustable mechanical phase shifters each having an independent remotely controlled drive and being directly electrically connected to a respective radiating column between the column signal node thereof and the feed node, the phase shifters each being independently operable to vary the phase shift equally for all of the radiating elements of the respective column to which the phase shifter is connected to thereby vary at least one of the beamwidth and the azimuth scan angle of the beam defined by the plurality of active radiating columns.

22. The antenna system of claim 21, wherein M=N.

23. The antenna system of claim 21, wherein M=N+1.

24. The antenna system of claim 21, wherein the active radiating columns are spaced apart in a linear pattern.

25. The antenna system of claim 21, wherein the active radiating columns are spaced apart in a curvilinear pattern.

26. The antenna system of claim 21, wherein M=8.

27. The antenna system of claim 21, wherein the active radiating columns are spaced apart at substantially quarter wavelength intervals.

28. The antenna system of claim 21, wherein the active radiating columns are spaced apart in a linearly segmented pattern.

29. The antenna system of claim 21, the columns being defined between a pair of outside columns and remaining columns therebetween, the remaining columns being arranged substantially in a plane.

30. The antenna system of claim 29, wherein the pair of outside columns are substantially arranged in a second plane.

31. The antenna system of claim 29, wherein the pair of outside columns are spaced apart from the first plane.

32. The antenna system of claim 31, wherein the pair of outside columns are substantially arranged in a second plane.

33. The antenna system of claim 29, wherein M=5.

34. The antenna system of claim 29, wherein the active radiating columns are spaced apart at approximately 0.466 wavelength intervals.

35. The antenna system of claim 21, wherein the mechanical phase shifters are located proximate the respective active radiating column.

36. The antenna system of claim 21, wherein the mechanical phase shifters are linear phase shifters.

37. The antenna system of claim 21, wherein the mechanical phase shifters are rotary phase shifters.

38. The antenna system of claim 21, further comprising a control station, the control station electronically communicating with the antenna using signals, each signal associated with a respective independently controlled drive and used to actuate the drive, thereby adjusting the phase shifter and varying the beamwidth of the antenna.

39. The antenna system of claim 38, wherein the signals are multiplexed.

40. The antenna system of claim 38, wherein the signals are communicated using at least one of a cable, an optical link, an optical fiber, and a radio signal.

41. A dynamically variable beamwidth and variable azimuth scanning antenna comprising:

a first plurality (M) of spaced-apart active radiating columns each having a plurality of radiating elements and a respective column signal node, the columns collectively defining a beam having a beamwidth correlated to phase shifts between the respective column signal nodes and a feed node; and a second plurality (N) of continuously adjustable mechanical phase shifters each having an independent remotely controlled drive and being directly electrically connected to a respective radiating column between the column signal node thereof and the feed node, the phase shifters each being independently operable to vary the phase shift equally for all of the radiating elements of the respective column to which the phase shifter is connected to thereby vary the beamwidth and the azimuth scan angle of the beam defined by the plurality of active radiating columns.

42. An antenna system, comprising:

a tower having a top and a base; and a dynamically variable beamwidth and variable azimuth scanning antenna mounted on the tower, the antenna comprising:

a first plurality (M) of spaced-apart active radiating columns each having a plurality of radiating elements and a respective column signal node, the columns collectively defining a beam having a beamwidth and an azimuth scan angle correlated to phase shifts between the respective column signal nodes and a feed node; and a second plurality (N) of continuously adjustable mechanical phase shifters each having an independent remotely controlled drive and being directly electrically connected to a respective radiating column between the column signal node thereof and the feed node, the phase shifters each being independently operable to vary the phase shift equally for all of the radiating elements of the respective column to which the phase shifter is connected to thereby vary the beamwidth and the azimuth scan angle of the beam defined by the plurality of active radiating columns.

43. A dynamically variable beamwidth antenna comprising:

a first plurality (M) of spaced-apart active radiating columns each having a plurality of radiating elements and a respective column signal node, the columns collectively defining a beam having a beamwidth correlated to phase shifts between the respective column signal nodes and a feed node; and a second plurality (N) of continuously adjustable mechanical phase shifters each having an independent remotely controlled drive and being directly electrically connected to a respective radiating column between the column signal node thereof and the feed node, the phase shifters each being independently operable to vary the phase shift equally for all of the radiating elements of the respective column to which the phase shifter is connected to thereby vary the beamwidth of the beam defined by the plurality of active radiating columns.

44. The antenna of claim 43, wherein M>N.

45. The antenna of claim 43, wherein the active radiating columns are spaced apart in a linearly segmented pattern.

46. The antenna of claim 43, the columns being defined between a pair of outside columns and remaining columns therebetween, at least the remaining columns being arranged substantially in a plane.

47. The antenna of claim 43, wherein the mechanical phase shifters are rotary phase shifters.

48. The antenna of claim 43, wherein the mechanical phase shifters are linear phase shifters.

49. The antenna of claim 43, further comprising a control station, the control station electronically communicating with the antenna using signals, each signal associated with a respective independently controlled drive and used to actuate the drive, thereby adjusting the phase shifter, and vary the beamwidth of the antenna.

50. A dynamically variable azimuth scanning antenna comprising:

a first plurality (M) of spaced-apart active radiating columns each having a plurality of radiating elements and a respective column signal node, the columns collectively defining a beam having an azimuth scan angle correlated to phase shifts between the respective column signal nodes and a feed node; and, a second plurality (N) of continuously adjustable mechanical phase shifters each having an independent remotely controlled drive and being directly electrically connected to a respective radiating column between the column signal node thereof and the feed node, the phase shifters each being independently operable to vary the phase shift equally for all of the radiating elements of the respective column to which the phase shifter is connected to thereby vary the azimuth scan angle of the beam defined by the plurality of active radiating columns.

51. The antenna of claim 50, wherein M>N.

52. The antenna of claim 50, wherein the active radiating columns are spaced apart in a linearly segmented pattern.

53. The antenna of claim 50, the columns being defined between a pair of outside columns and remaining columns therebetween, at least the remaining columns being arranged substantially in a plane.

54. The antenna of claim 50, wherein the mechanical phase shifters are rotary phase shifters.

55. The antenna of claim 50, wherein the mechanical phase shifters are linear phase shifters.

56. The antenna of claim 50, further comprising a control station, the control station electronically communicating with the antenna using signals, each signal associated with a respective independently controlled drive and used to actuate the drive, thereby adjusting the phase shifter, and vary the azimuth scan angle of the antenna.

57. A method of dynamically varying the beamwidth of an antenna comprising:

exciting a first plurality (M) of spaced-apart active radiating columns at respective column signal nodes so that the columns collectively define a beam, each column having a plurality of radiating elements;

varying the phase of signals to the columns with a second plurality (N) of continuously adjustable mechanical phase shifters and defining a beamwidth with the phase shifts;

independently remotely controlling the phase shifters for the columns through respective independent remotely controlled drives of the phase shifters to independently vary the phase shifts equally for all of the radiating elements of the respective column to which a phase shifter is connected and thereby vary the beamwidth of the beam.

58. The method of claim 57 wherein M>N.

59. The method of claim 57 wherein the active radiating columns are spaced apart in a linearly segmented pattern.

60. The method of claim 57 wherein the active radiating columns are spaced apart in a curvilinear pattern.

61. The method of claim 57, the columns being defined between a pair of outside columns and remaining columns therebetween, at least the remaining columns being arranged substantially in a plane.

62. The method of claim 57, further comprising electronically communicating with the antenna using signals, each signal associated with a respective independently controlled drive and used to actuate the drive, thereby adjusting the phase shifter, and varying the beamwidth of the antenna.

63. A method of dynamically varying the azimuth scanning of an antenna comprising:

exciting a first plurality (M) of spaced-apart active radiating columns at respective column signal nodes so that the columns collectively define a beam, each column having a plurality of radiating elements;

varying the phase of signals to the columns with a second plurality (N) of continuously adjustable mechanical phase shifters and defining an azimuth scan angle with the phase shifts;

independently remotely controlling the phase shifters for the columns through respective independent remotely controlled drives of the phase shifters to vary the phase shift equally for all of the radiating elements of the respective column to which a phase shifter is connected and thereby vary the azimuth scan angle of the beam.

64. The method of claim 63, wherein M>N.

65. The method of claim 63, wherein the active radiating columns are spaced apart in a linearly segmented pattern.

66. The method of claim 63 wherein the active radiating columns are spaced apart in a curvilinear pattern.

67. The method of claim 63, the columns being defined between a pair of outside columns and remaining columns therebetween, at least the remaining columns being arranged substantially in a plane.

68. The method of claim 63, further comprising electronically communicating with the antenna using signals, each signal associated with a respective independently controlled drive and used to actuate the drive, thereby adjusting the phase shifter, and varying the azimuth scan angle of the antenna.

* * * * *

UNITED STATES PATENT AND TRADEMARK OFFICE

CERTIFICATE OF CORRECTION

PATENT NO. : 6,963,314 B2
APPLICATION NO. : 10/255747
DATED : November 8, 2005
INVENTOR(S) : David B. Webb et al.

It is certified that error appears in the above-identified patent and that said Letters Patent is hereby corrected as shown below:

Column 1, line 25, reads “angle may be, changed by”
and should read --angle may be changed by--

Column 3, line 5, reads “scan angle 33, 39 of the”
and should read --scan angle 37, 39 of the--

Column 5, line 55, reads “as indicated at by arrow 90”
and should read --as indicated by arrow 90--

Column 7, line 1, reads “reflectors 138ac including”
and should read --reflectors 138a-c including--

Column 7, line 13, reads “may be used to electromagnetically coupling”
and should read --may be used to electromagnetically couple--

Column 7, line 21, reads “and indicted by reference numeral”
and should read --and indicated by reference numeral--

Signed and Sealed this

Twenty-fifth Day of July, 2006

JON W. DUDAS
*Director of the United States Patent and Trademark Office*